US006764235B2

(12) United States Patent
Coret et al.

(10) Patent No.: US 6,764,235 B2
(45) Date of Patent: Jul. 20, 2004

(54) LABEL DISPENSER FOR FRANKING MACHINE

(75) Inventors: Francis Coret, Gournay sur Marne (FR); Thierry Le Jaoudour, Verrieres le Buisson (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 10/004,839

(22) Filed: Dec. 7, 2001

(65) Prior Publication Data

US 2002/0084303 A1 Jul. 4, 2002

(30) Foreign Application Priority Data

Dec. 13, 2000 (FR) ..... 00 16201

(51) Int. Cl.[7] ..... B41J 15/00
(52) U.S. Cl. ..... 400/613; 101/288; 101/484
(58) Field of Search ..... 101/288, 484; 400/613, 621

(56) References Cited

U.S. PATENT DOCUMENTS

| | | | | |
|---|---|---|---|---|
| 3,029,728 A | | 4/1962 | Polk, Jr. | |
| 3,564,219 A | * | 2/1971 | Mutziger | 377/24 |
| 3,749,013 A | * | 7/1973 | Ellner | 101/227 |
| 4,151,403 A | * | 4/1979 | Woolston | 702/163 |
| 4,280,159 A | * | 7/1981 | Nakayama | 360/137 |
| 4,441,197 A | | 4/1984 | Baun et al. | |
| 4,479,159 A | * | 10/1984 | Kamei et al. | 360/137 |
| 4,644,436 A | * | 2/1987 | Unno | 360/137 |
| 4,787,311 A | | 11/1988 | Mol | |
| 4,840,696 A | * | 6/1989 | Krasuski et al. | 156/353 |
| 5,247,323 A | * | 9/1993 | Weber | 242/348.4 |
| 5,390,594 A | | 2/1995 | Nobile et al. | |
| 5,450,116 A | * | 9/1995 | Weiselfish et al. | 347/171 |
| 5,996,664 A | | 12/1999 | Gregoire | |
| 6,363,690 B1 | * | 4/2002 | Lay et al. | 53/410 |

FOREIGN PATENT DOCUMENTS

| | | | |
|---|---|---|---|
| EP | 0 376 575 A2 | | 7/1990 |
| EP | 0 724 232 A2 | | 7/1996 |
| EP | 0 961 235 A2 | | 12/1999 |
| WO | WO 00/41960 | * | 7/2000 |

* cited by examiner

*Primary Examiner*—Daniel J. Colilla
*Assistant Examiner*—Jill E. Culler
(74) *Attorney, Agent, or Firm*—Sughrue Mion, PLLC

(57) ABSTRACT

The present invention relates to a label dispenser for franking machine comprising, on the one hand, a delivery roller on which a continuous tape of labels is wound and a drive means for conveying this tape along a dispenser conveying path from this delivery roller towards a label inlet of the franking machine, and, on the other hand, first means for measuring a displacement of the drive means, second means for measuring a displacement of the delivery roller and processing means for determining a remaining length of the continuous tape of labels from the first and second displacement measuring means.

7 Claims, 1 Drawing Sheet

LABEL DISPENSER FOR FRANKING MACHINE

FIELD OF THE INVENTION

The present invention relates to the exclusive domain of mail processing and concerns a label tape dispenser intended to equip a franking machine and provided with a device indicating consumption thereof.

BACKGROUND OF THE INVENTION

Most of the franking machines used for franking mail-pieces comprise a label tape dispenser allowing a label to be printed instead of direct printing on the mailpiece. Such printing on labels thus makes it possible to frank parcels or large envelopes which, due to their dimensions, cannot pass through the franking machine.

Such a refillable dispenser (the tape bearing the labels is a consumable) conventionally comprises, enclosed in a cartridge, a delivery roller and at least two pairs of drive rollers disposed on either side of a cutting module intended to define a given length for the label. The drive rollers which ensure unwinding of the label tape are actuated by a control motor through kinematics incorporating gears, pulleys and belts for example, and speed and position sensors are provided to allow precise cut-out of the tape.

At the present time, there is no control of the unwinding of the tape, and existing dispensers deliver labels until they are empty.

Now, the quantity of remaining tape is of non-negligible importance to warn that the dispenser is soon to be changed or refilled by introduction of a fresh tape. This importance is particularly real in high-output franking machines which can print a very large number of labels at high speeds.

It is an object of the present invention to provide a label dispenser for franking machine which can indicate the consumption of the label tape and in particular indicate, at least approximately, the quantity of tape remaining. Another object of the invention is to provide this indication at low cost.

SUMMARY OF THE INVENTION

To that end, the present invention relates to a label tape dispenser for a franking machine, comprising a delivery roller on which is wound a continuous tape of labels, a drive means for conveying this tape along a dispenser conveying path from said delivery roller towards a label inlet of the franking machine, characterized in that it further comprises, on the one hand, mounted on said drive means, a first coding means for measuring an angular displacement of said drive means and, on the other hand, mounted on said delivery roller, a second coding means for measuring an angular displacement of said delivery roller, and in that processing means are provided for calculating, from said measurements of angular displacement, a remaining length of said continuous tape of labels.

By this simple measurement of two particular displacements, it is thus possible to know the length of tape remaining in the dispenser with sufficient accuracy and to warn the user of the franking machine that a change or refill will soon be necessary.

The processing means comprise means for calculating and controlling the display of different thresholds corresponding respectively to 100%, 75%, 50%, 25% and 0% of said remaining length of tape.

Depending on the embodiment envisaged, the display is effected either directly at the level of the label dispenser on a display means assigned thereto, or on a user interface of the franking machine.

According to a preferred embodiment, the first and second coding means are each constituted by an optical coder comprising an optical emitter/receiver cooperating with a coder disc on which slots which define a step of unitary displacement of the coding means, are made at regular intervals. The optical coders preferably have equal unitary displacement steps.

BRIEF DESCRIPTION OF THE DRAWINGS

The invention will be more readily understood on reading the following description given by indicative and non-limiting example, with reference to the accompanying drawings, in which.

DESCRIPTION OF PREFERRED EMBODIMENT

Figure 1:
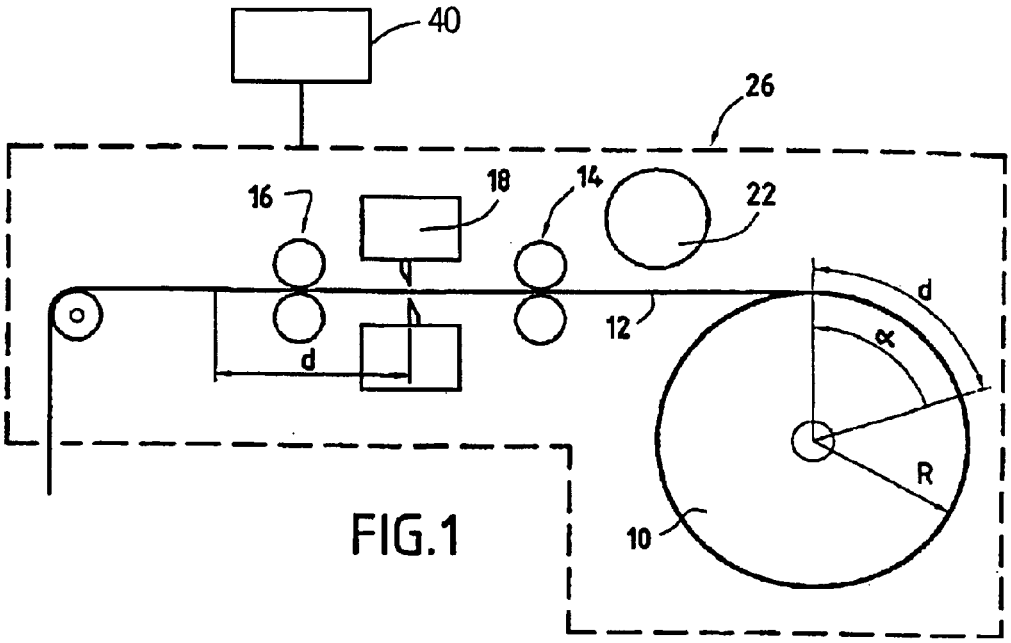
FIG. 1 is a schematic plan view of a label dispenser according to the invention.
Figure 2:
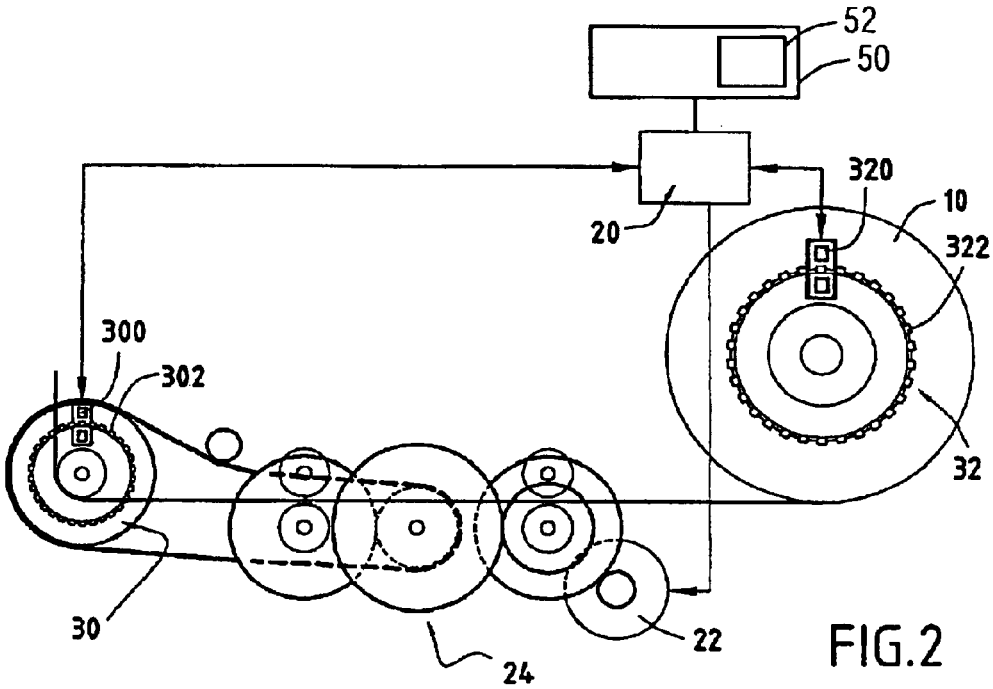
FIG. 2 is a schematic view from underneath of a label dispenser according to the invention.

Referring now to the drawings, FIGS. 1 and 2 schematically illustrate a plan view and a view from underneath of a dispenser of label tape intended to equip a franking machine.

This dispenser comprises a delivery roller 10 on which is wound a continuous tape 12 of labels to be cut our (or even pre-cut out), at least two pairs 14, 16 of drive rollers for conveying this tape along a dispenser conveying path from this delivery roller towards a label inlet of the franking machine 50, and a cutting module 18 placed on this conveying path, advantageously between the two pairs of drive rollers, and intended, under the control of processing means 20 (advantageously a microprocessor computing module), to define a given length for the label to be cut out. The drive rollers which ensure unwinding of the label tape are actuated by a control motor 22 through kinematics 24 incorporating gears, pulleys and belts, likewise actuated under the control of the processing means. Speed and position sensors (not shown) are also provided to allow the cut out of the tape to be precisely monitored. All these elements are mounted in a body or casing of the dispenser 26.

According to the invention, at least one of the rollers driving the label tape is provided with a first coding means 30 intended to measure the angular displacement of this roller and therefore, by correspondence, the linear displacement of the label tape. In effect, if d denotes the distance of displacement of the tape, it may then be shown that $d=X*L1$ where L1 is the step of unitary displacement of the first coding means and X the number of pulses (pips) of this first coding means over this distance d. Similarly, the delivery roller 10 is also provided with a second coding means 32 intended, this time, to measure the angular displacement of this delivery roller. For the same distance d, this roller will move through an angle $\alpha=d/R$ where R is the radius of the delivery roller. Now, it may also be shown that $\alpha=Y*L2$ where L2 is the step of unitary displacement of the second coding means and Y the number of pulses of this second coding means over this distance d. These two coding means 30, 32 are each connected to the processing means 20.

In this way, by making the ratio of the number of pips of the two coding means $X/Y=(d/L1)/(d/(R*L2))=R\ (L1/L2)$, a direct representation is obtained of the radius of the delivery roller and therefore of the remaining length of the continuous tape of labels. In particular, if the steps of unitary displacement of the two coding means are chosen to be identical, then X/Y=R. The display of different thresholds, for example 100% of R, 75%, 50%, 25% and 0% (noted by the absence of pip on the second coding means) will make it possible to judge more simply the length of tape remaining. Such display will preferably be effected on a user interface 52 of the franking means 50 via the processing means 20 of the dispenser. However, it may be envisaged to effect this display directly at the level of the label dispenser on a display 40 especially intended for this function.

The first and second coding means are advantageously of optical coder type with an optical emitter/receiver 300, 320 fast with the body or casing of the dispenser cooperating with a coder disc 302, 322 fast with the drive roller or the mobile roller and on which slots which define the step of unitary displacement of the coding means are made at regular intervals. It is the interaction of each of these slots with the beam of light issuing from the optical emitter and directed towards the optical receiver located opposite, which will generate a determined number of pulses (i.e. the number of times that the beam is transmitted or interrupted) of the coder disc during its rotation. It may be noted that the use of coding means of inductive type (inductive detectors associated with a toothed coder disc made of magnetic material) or with Hall effect, may also be envisaged.

What is claimed is:

1. Label tape dispenser for a franking machine, comprising a delivery roller on which is wound a continuous tape of labels, a drive means for convoying this tape along a dispenser conveying path from said delivery roller towards a label inlet of the franking machine, a first coding means mounted on said drive means, for measuring an angular displacement of said drive means, a second coding means mounted on said delivery roller, for measuring an angular displacement of said delivery roller, and processing means for calculating, from said measurements of angular displacement, a remaining length of said continuous tape of labels, wherein said remaining length of the continuous tape of labels corresponds to a ratio of said angular displacements measured by the first and second coding means.

2. The tape dispenser of claim 1, wherein said processing means comprises means for calculating and controlling a display of different thresholds corresponding respectively to 100%, 75%, 50%, 25% and 0% of said remaining length of tape.

3. The tape dispenser of claim 2, wherein said display is effected directly at the level of the label dispenser on a display means assigned thereto.

4. The tape dispenser of claim 2, wherein said display is effected on a user interface of the franking machine.

5. The tape dispenser of claim 1, wherein said first and second coding means are each constituted by an optical coder comprising an optical emitter/receiver cooperating with a coder disc on which slots defining a step of unitary displacement of the coding means are made at regular intervals.

6. The tape dispenser of claim 5, wherein said optical coders present equal steps of unitary displacement.

7. Label tape dispenser for a franking machine comprising a delivery roller on which a continuous tape of labels is wound, drive means for conveying said tape along a dispenser conveying path from said delivery roller towards a label inlet of the franking machine, first means for measuring a displacement of said drive means, second means for measuring a displacement of said delivery roller and processing means for determining a remaining length of said continuous tape of labels from said first and second displacement measuring means, wherein said remaining length of the continuous tape of labels corresponds to a ratio of said first and second measured displacements.

* * * * *